US006639347B2

(12) United States Patent
Ko

(10) Patent No.: US 6,639,347 B2
(45) Date of Patent: Oct. 28, 2003

(54) COLOR CATHODE RAY TUBE

(75) Inventor: Chang Gi Ko, Gumi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/969,813

(22) Filed: Oct. 4, 2001

(65) Prior Publication Data

US 2002/0185958 A1 Dec. 12, 2002

(30) Foreign Application Priority Data

May 10, 2001 (KR) ..... 2001-25391

(51) Int. Cl.[7] ..... H01J 29/10
(52) U.S. Cl. ..... 313/461; 313/477 R; 220/2.1 A
(58) Field of Search ..... 313/477 R, 462, 313/461; 220/2.1 A, 2.3 A

(56) References Cited

U.S. PATENT DOCUMENTS 6,025,676 A * 2/2000 Ohama et al. ..... 313/477 R
6,433,470 B1 * 8/2002 Watanabe et al. ..... 313/461

* cited by examiner

*Primary Examiner*—Ashok Patel
(74) *Attorney, Agent, or Firm*—Birch, Stewart, Kolasch & Birch, LLP

(57) ABSTRACT

In a color cathode ray tube, a rectangular panel has a slightly convex outer face with a large radius of outward curvature so as to be almost flat and a concave inner face which satisfies the conditions 0.98<Rh/Rd<1.02, 0.95<Rv/Rd<1.04, 0.98<Rt/Rh<1.02, and 0.98<Rs/Rv<1.05, where Rd is the radius of diagonal curvature along a screen effective surface area, Rt is the radius of a long side peripheral curvature, Rs is the radius of a short side peripheral curvature, Rh is the radius of curvature along the x-axis passing through a center of the screen effective surface area and parallel to the long side, and Rv is the radius of curvature along the y-axis passing through the center of the screen effective surface area and parallel to the short side. Accordingly, distortion of a picture can be minimized by designing the internal curvature of the panel as an optimum shape, and a high picture quality can be obtained.

12 Claims, 5 Drawing Sheets

COLOR CATHODE RAY TUBE

BACKGROUND OF THE INVENTION

1. Field of the Invention

The present invention relates to a color cathode ray tube, and in particular o a color cathode ray tube which is capable of obtaining a high picture quality by minimizing the distortion of a picture by designing an internal curvature of a panel to an optimum shape.

2. Description of the Prior Art

In general, as depicted in FIG. 1, a color cathode ray tube includes a panel 3 coated on a rear surface with a R, G, B fluorescent screen 1, an funnel 4 coupled to a rear edge of the panel 3, an electron gun 7 inserted into a neck portion 5 of the funnel 4 and emitting an electron beam 6, and a shadow mask 8 installed at the rear of the panel 3 with a certain distance and having a plurality of holes as passages for the electron beam 6. The shadow mask is typically under a tension.

In the prior art, as depicted in FIG. 2, in an internal curvature of the panel 3, a radius Rd of a diagonal curvature is larger than a radius Rv of a short side curvature and is smaller than a radius Rh of a long side curvature.

In more detail, in the panel 3 in accordance with the prior art, Rh/Rd is not less than 1.1, and Rv/Rd is not greater than 0.8.

When the radius difference between the long side curvature, short side curvature and diagonal curvature is large, because a structural stiffness at a corner portion of the shadow mask 8 is reduced especially, the shadow mask 8 may be easily deformed due to an outward impact, and accordingly a drop characteristic drastically decreases and an image distortion occurs.

In addition, when an electron beam is emitted in a horizontal direction or a vertical direction in a general cathode ray tube, the distance from a deflection center to a center portion, a short side portion or a long side portion of an screen effective surface area is different from each other, and accordingly when a vertical line or a horizontal line is displayed, an image distortion phenomenon occurs (i.e., the vertical line or the horizontal line is distorted). The image distortion phenomenon becomes more serious in a scaled-up and flat screen cathode ray tube.

In particular, when an operation such as a CAD (Computer Aided Design) is performed, a straight line may be distorted as a curved line or a true circle may be distorted as an oval shape, and accordingly the usefulness is drastically reduced.

SUMMARY OF THE INVENTION

In order to solve the above-mentioned problems, it is an object of the present invention to provide a color cathode ray tube which is capable of increasing the structural stiffness of a shadow mask and improving a reliability about an outward impact by designing a radius of long side curvature, short side curvature and diagonal curvature as an optimum state.

In order to achieve the above-mentioned object, there is provided a color cathode ray tube having an almost flat screen outer surface and an internal panel curvature satisfying the following conditions:

$$0.98<Rh/Rd<1.02,$$

$$0.95<Rv/Rd<1.04,$$

$$0.98<Rt/Rh<1.02, \text{ and}$$

$$0.98<Rs/Rv<1.05,$$

wherein Rd is the radius of diagonal section curvature within a screen effective surface area, Rt is the radius of circumference section curvature along a long side, Rs is the radius of circumference section curvature along a short side, Rh is the radius of section curvature on the x axis passing through a center of the screen effective surface area and parallel to the long side, and Rv is the radius of section curvature on the y axis passing through the center of the screen effective surface area and parallel to the short side.

DETAILED DESCRIPTION OF THE PREFERRED EMBODIMENT

Hereinafter, the color cathode ray tube in accordance with the present invention will be described with reference to the accompanying drawings.

Figure 2:
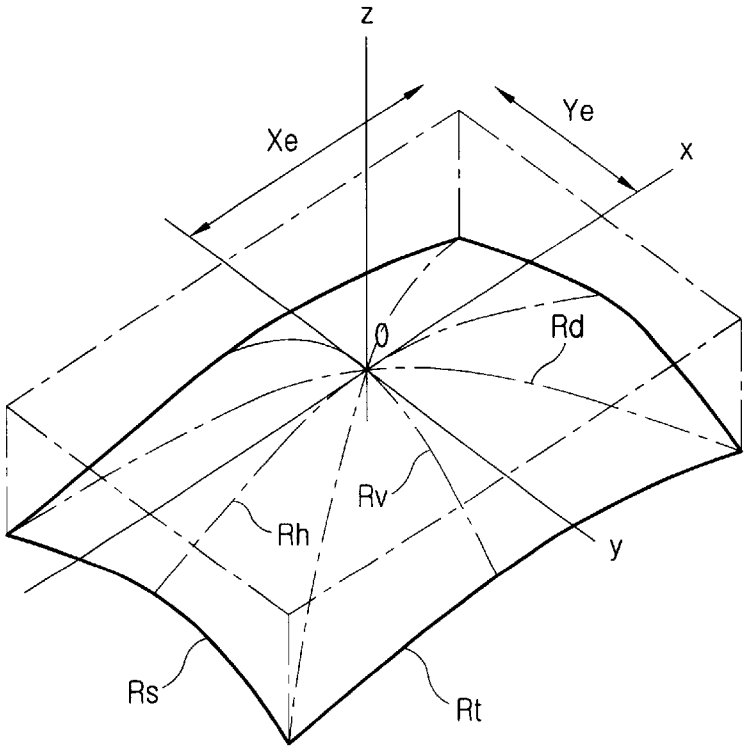
FIG. 2 PRIOR ART
FIG. 2 is a perspective view illustrating a panel included in a color cathode ray tube.

As depicted in FIG. 2, a panel of a color cathode ray tube in accordance with the present invention is shaped so as to satisfy a range of 0.98<Rh/Rd<1.02, and 0.95<Rv/Rd<1.04 wherein Rd is the radius of diagonal section curvature within a screen effective surface area, Rt is the radius of circumference section curvature along a long side, Rs is the radius of circumference section curvature along a short side, Rh is the radius of section curvature along the x axis passing through the center of the screen effective surface area and parallel to the long side, and Rv is the radius of section curvature along the y axis passing through the center of the screen effective surface area and parallel to the short side.

Figure 3:
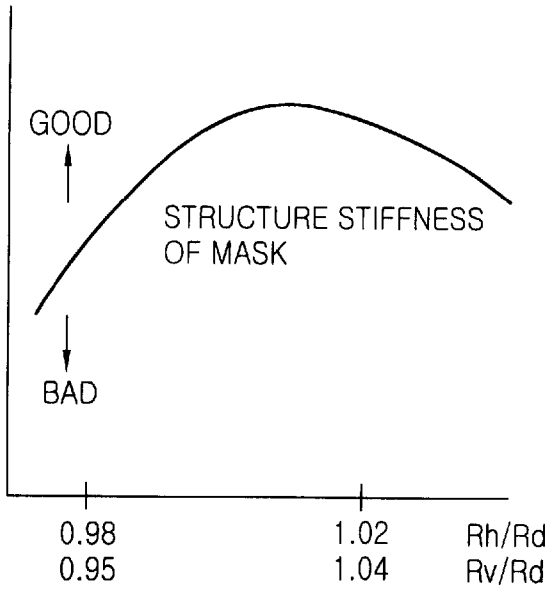
FIG. 3 is a graph illustrating the variation in the mask structural stiffness according to the radius of internal curvature of a panel in accordance with the present invention.

As depicted in FIG. 3, when the panel does not satisfy the range of 0.98<Rh/Rd<1.02, 0.95<Rv/Rd<1.04, wherein Rh is the radius of section curvature along the x axis passing through the center of the screen effective surface area and parallel to the long side, Rv is the radius of section curvature along the y axis passing through the center of the screen effective surface area and parallel to the short side, and Rd is the radius of diagonal section curvature within the screen effective surface area, the structural stiffness of a shadow mask is reduced lowers and the shadow mask is easily deformed by an external impact, and accordingly an image distortion occurs.

Below Table 1 shows the results of a drop characteristic experiment according to the radius of internal curvature of a panel of a color cathode ray tube.

TABLE 1

| Rh/Rd | Quality | Rv/Rd | Quality |
|---|---|---|---|
| 0.94 | Mislanding | 0.91 | Mislanding |
| 0.96 | Reflection of another color | 0.93. | Reflection of another color |
| 0.98 | Good | 0.95 | Good |
| 1.00 | Good | 1.00 | Good |
| 1.02 | Good | 1.04 | Good |
| 1.04 | Reflection of another color | 1.06 | Reflection of another color |
| 1.06 | Mislanding | 1.08 | Mislanding |

Figure 1:
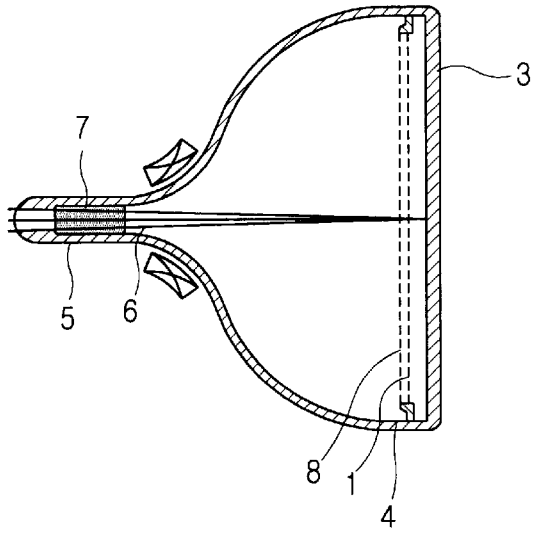
FIG. 1 PRIOR ART
FIG. 1 is a longitudinal sectional view illustrating a typical color cathode ray tube.

In general, the drop characteristic can be measured by checking the picture quality of a screen, and especially, it can be easily measured at a corner portion after dropping a cathode ray tube onto the ground from a certain height. As depicted in FIG. 1, a sufficient drop characteristic can be obtained when the internal curvature of the panel is in the range of $0.98<Rh/Rd<1.02$, $0.95<Rv/Rd<1.04$.

However, as shown in Table 1, when Rh/Rd was 0.96 or 1.04 and Rv/Rd was 0.93 or 1.06, reflection of another color occurred, and when Rh/Rd was 0.94 or 1.06 and Rv/Rd was 0.91 or 1.08, an mislanding was shown.

Accordingly, when the internal curvature of the panel is in the range of $0.98<Rt/Rh<1.02$ and $0.95<Rs/Rv<1.05$, the drop characteristic improves, but on the contrary when the internal curvature of the panel is not in the range of $0.98<Rh/Rd<1.02$ and $0.95<Rv/Rd<1.04$, reflection of another color occurs or an mislanding is shown, and accordingly the drop characteristic drastically lowers.

Next, the panel is shaped so as to satisfy the range of $0.98<Rt/Rh<1.02$ and $0.95<Rs/Rv<1.05$, where Rt is the radius of circumference section curvature along a long side, Rh is the radius of section curvature along the x axis passing through a center of the screen effective surface area and parallel to the long side, Rs is the radius of circumference section curvature along a short side, and Rv is the radius of section curvature along the y axis passing through the center of the screen effective surface area and parallel to the short side.

With reference to FIG. 2, when $Rt/Rh>1.02$, the internal concave curvature deteriorates due to the greater difference between the radius of circumference section curvature Rt along the long side and the radius of curvature Rh (through the center).

In more detail, because the curvature along the center portion of the panel is drastically lower in comparison with the long side peripheral curvature, an inflection point occurs at the internal surface of the panel, and accordingly the quality of the panel and screen image is lowered.

Figure 4:
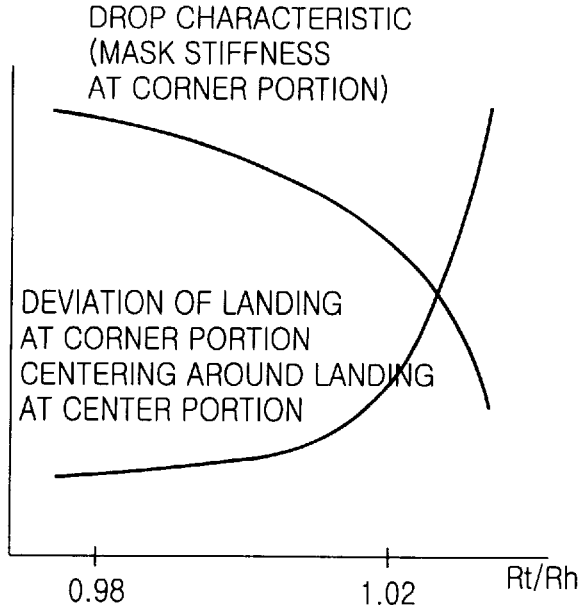
FIG. 4 is a graph illustrating the variation in a drop characteristic and deviation of a landing spot according to the radius of internal curvature of a panel in accordance with the present invention.
Figure 5:
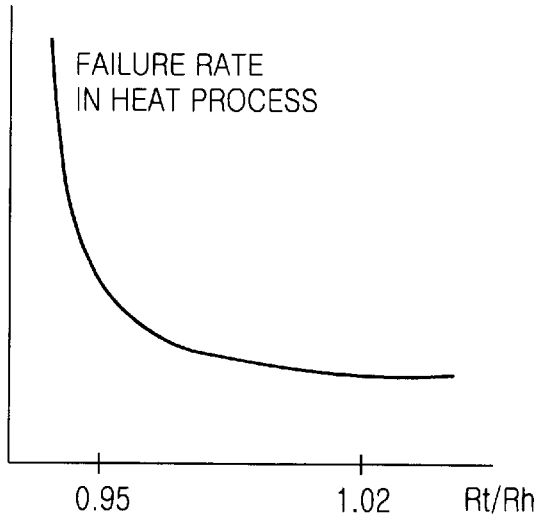
FIG. 5 is a graph illustrating the failure rate variation according to the radius of internal curvature of a panel in accordance with the present invention.

In addition, as depicted in FIG. 4, when the curvature of the corner portion relatively increases, because the distance difference increases in deflection of an electron beam by the deflection yoke, the quality of a screen image is lowered due to an increase in mislanding caused by a convergence deterioration and a pin cushion distortion.

On the contrary, when $Rt/Rh<0.98$, the internal curvature of the panel is drastically reduced due to the big difference between the radius of circumference section curvature along the long side Rt and the radius of long side section curvature Rh through the center. In other words, because the center portion curvature Rh is drastically increased in comparison with the long side peripheral portion curvature Rt, an inflection point occurs at the internal surface of the panel, and accordingly the quality of the panel and of a screen image is lowered.

Figure 6:
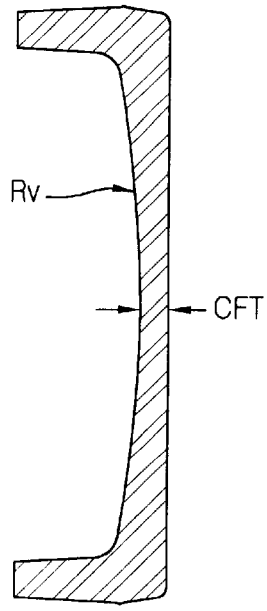
FIG. 6 is a longitudinal cross-sectional view illustrating a panel in accordance with the present invention.

In addition, as depicted in FIG. 6, when the curvature along the long side of the panel relatively decreases, the glass thickness of the corner portion of the panel increases, and a wedge rate indicating the ratio between the glass thickness in the center portion of the panel (CFT) and the glass thickness in the corner portion of the panel increases. Herein, when the wedge rate increases with the same CFT, the weight of the glass panel increases and the manufacturing cost increases, and a failure rate in a heating process required in manufacturing of the cathode ray tube increases.

In other words, because a heat stress difference between the center portion and the corner portions of the panel increases as the wedge rate increases, accordingly a higher breakage rate of panels occurs during manufacturing.

When $Rs/Rv>1.0$ or $Rs/Rv<0.95$, the above-mentioned problem occurs.

Accordingly, it is advisable to set the panel shape so as to satisfy the range of $0.98<Rh/Rd<1.02$ and $0.95<Rv/Rd<1.04$.

Next, in the cathode ray tube in accordance with the prior art, when the radius of external curvature of the panel is not less than 30000 mm and the radius of internal curvature of the panel is several times less than the radius of external curvature of the panel, the panel appears more flat than its actual curvature due to a deflective effect of the panel glass.

Figure 7:
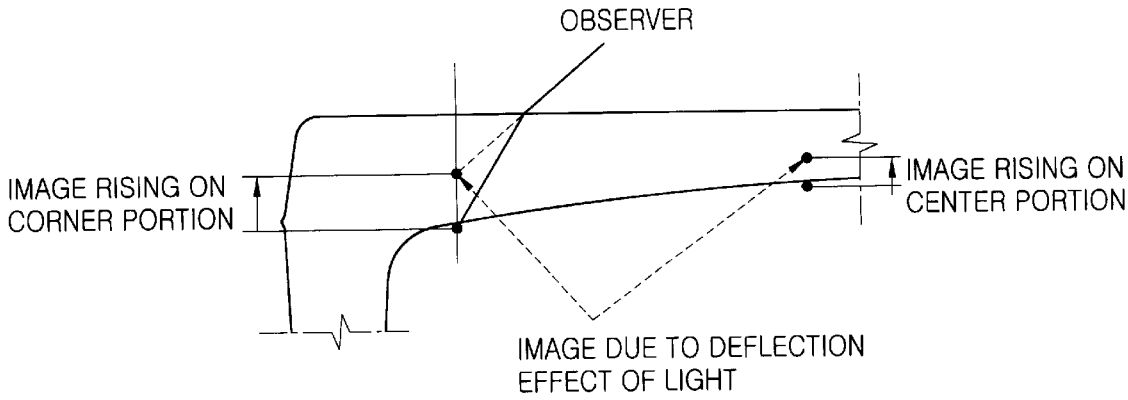
FIG. 7 is a schematic sectional view which illustrates a deflection effect of a typical panel.

As depicted in FIG. 7, when light passes through a curved portion of the panel glass, an image rising effect occurs due to the deflective effect of the panel glass, and accordingly an image appears in an observer's eyes at a point higher than an actual image occurrence point.

Therefore, there is a difference between the actual curvature and a bodily curvature sensation perceived by the observer, and thus there is setting of the panel in order to improve the bodily curvature sensation perception of the observer.

Figure 8:
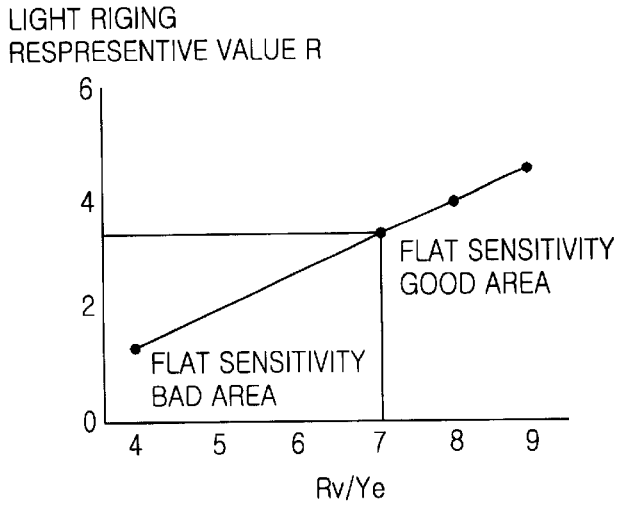
FIG. 8 is a graph illustrating a screen flat sensitivity according to the radius of internal curvature of a panel and a light rising representative value in accordance with the present invention.

FIG. 8 is a graph illustrating a flatness sensitivity of a screen, wherein Rv/Ye plotted along the x axis is a value derived by dividing the radius of internal section curvature of the panel Rv by one-half of the longitudinal size of the screen effective surface area of the screen Ye, and the light rising representative value R is a value representing about a screen flatness sensitivity considering an image rising effect caused by the deflection effect, and the flat sensitivity of the observer improves as the light rising representative value increases.

The light rising representative value R can be calculated by the below equations.

Relative position=imaginary image position at corner portion−imaginary image position at center portion Radius of light rising curvature=(Relative position$^2$+$Ye^2$)/(2×relative position)

Light rising representative value $R$=Radius of light rising curvature/(2×$Ye$×1.767)

In an experiment, the observer could feel the flat sensitivity when the light rising representative value R was not less than 3.5, which means that Rv/Ye has to be not less than 7 in FIG. 7. For example, when it is Ye=200 mm, Rv has to be not less than 1400 mm.

In the meantime, in a cathode ray tube having an external curvature of the panel with a radius of not less than 30000 mm, namely, an almost a flat external surface of the panel, an internal curvature of the internal surface of the panel directly affects the structural rigidity.

Figure 9:
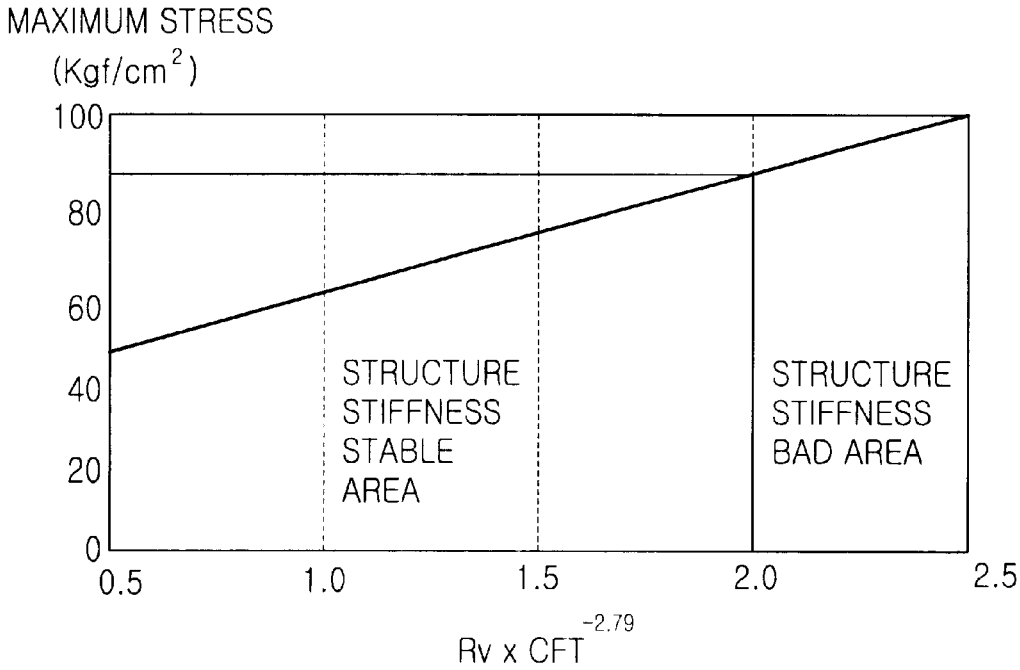
FIG. 9 is a graph illustrating the relationship between a structural stiffness according to the radius of internal curvature of the panel and the maximum stress in accordance with the present invention.

In more detail, in the graph of FIG. 9, Rv×CFT is plotted on the x axis, and the maximum stress on the cathode ray tube is plotted on the y axis. Here, the maximum stress is placed on the cathode ray tube by the atmospheric pressure, and the structural stiffness will increase as the maximum stress decreases.

As depicted in FIG. 9, in order to have a stable structural stiffness, generally the panel has to be designed to withstand not greater than 80~90 kgf/cm$^2$ as the maximum stress.

In the value Rv×CFT plotted along the x axis in the graph of FIG. 9, CFT(Center Face plate thickness) is the thickness of the panel center portion. It is advantageous to the structural stiffness of the panel that CFT increases; however when the CFT is too thick, it is disadvantageous in several aspects such as the weight increase, the flatness sensitivity decrease as well as the heat deterioration, etc., and accordingly the CFT has to be set appropriately.

In addition, when the radius of short side internal curvature Rv increases, the flatness sensitivity increases, however when the radius of short side internal curvature Rv is greater than a certain level, the structural stiffness of the shadow mask decreases. The inside of the cathode ray tube is in a high vacuum state, so it is continually affected by the atmospheric pressure. Accordingly the Rv value has to be set so as to withstand the atmospheric pressure.

Rv×CFT$^{-2.79}$ as an x-axis value in FIG. 9 is a combination considering the two factors, Rv and CFT, largely affecting the structural stiffness of the cathode ray tube. When the x-axis value of Rv×CFT is more than 2.0, it is disadvantageous to the structural stiffness.

As described above, the color cathode ray tube in accordance with the present invention is advantageous for enhancing the durability of a color cathode ray tube against the atmospheric pressure by designing the internal curvature of the panel as an optimum shape, and improving the color purity by minimizing the deviation of landing by reducing the distance difference by portions in deflection of an electron beam by a deflection yoke.

In addition, the color cathode ray tube in accordance with the present invention is advantageous for improving the reliability of a color cathode ray tube against an external impact by securing a sufficient structural stiffness of a shadow mask, decreasing a breakage rate of the panel in a heating process by reducing a heat stress distribution difference between the center portion and corner portions of the panel, reducing the production cost by facilitating fabrication in production of a panel, and having a good flatness sensitivity.

What is claimed is:

1. A color cathode ray tube, comprising:

a rectangular panel having a slightly convex almost flat outer face and a concavely curved inner face satisfying the following conditions:

$$0.98<Rh/Rd<1.02,$$

$$0.95<Rv/Rd<1.04,$$

$$0.98<Rt/Rh<1.02,$$

$$0.98<Rs/Rv<1.05,$$

where Rd is the radius of diagonal curvature between opposite corners of the panel within a screen effective surface area, Rt is the radius of peripheral edge curvature along a long side of the panel, Rs is the radius of peripheral edge curvature along a short side of the panel, Rh is the radius of curvature along an x-axis passing through a center of the screen effective surface area and parallel to the long sides of the panel, and Rv is the radius of curvature along a y-axis passing through the center of the screen effective surface area and parallel to the short sides of the panel.

2. The color cathode ray tube according to claim 1, wherein the panel is shaped so as to satisfy the condition:

$$Rv/Ye>7$$

where Ye is ½ of the length of short side of the panel.

3. The color cathode ray tube according to claim 1, wherein the panel is shaped so as to satisfy the condition:

$$Rv\times CFT^{-2.79}<2.0$$

where CFT(Center Face plate Thickness) is a thickness of a center portion of the panel.

4. The color cathode ray tube according to claim 1, wherein the panel shaped so as to satisfy the following conditions:

$$Rv/Ye>7, \text{ and}$$

$$Rv\times CFT^{-2.79}<2.0$$

where Ye is ½ of the length of a short side of the panel, and CFT is the thickness of a center portion of the panel.

5. A color cathode ray tube, comprising;

a rectangular panel having a slightly convex almost flat outer face and a concavely curved inner face satisfying the following conditions:

$$0.98<Rh/Rd<1.02, \text{ and}$$

$$0.95<Rv/Rd<1.04$$

wherein Rd is the radius of curvature along a diagonal of a screen effective surface area, Rh is the radius of curvature along an x-axis passing through a center of the screen effective surface area of the panel and parallel to a long side of the panel, and Rv is the radius of curvature on a y-axis passing through the center of the screen effective surface area and parallel to a short side of he panel.

6. The color cathode ray tube according to claim 5, wherein the panel is shaped so as to satisfy the following conditions:

$$Rv/Ye>7, \text{ and}$$

$$Rv\times CFT^{-2.79}<2.0$$

where Ye is ½ of the length of a short side of the panel, and CFT (Center Face plate Thickness) is the thickness of a center portion of the panel.

7. The color cathode ray tube according to claim 5, wherein the panel is shaped so as to satisfy the condition:

$$Rv/Ye>7$$

where Ye is ½ of the length of short side of the panel.

8. The color cathode ray tube according to claim 5, wherein the panel is shaped so as to satisfy the condition:

$$Rv \times CFT^{-2.79} < 2.0$$

where CFT (Center Face plate Thickness) is a thickness of a center portion of the panel.

9. A color cathode ray tube, comprising:

a rectangular panel having a slightly convex almost flat outer face and an inner face satisfying the following conditions:

$$0.98 < Rt/Rh < 1.02, \text{ and}$$

$$0.98 < Rs/Rv < 1.05$$

wherein Rh is the radius of curvature along an x-axis passing through a center of a screen effective surface area of the panel and parallel to a long side of the panel, Rt is the radius of peripheral curvature along the long side of the panel, Rv is the radius of curvature along a y-axis passing through the center of the screen effective surface area and parallel to a short side of the panel, and Rs is the radius of peripheral curvature along the short side of the panel, and the panel is shaped so as to satisfy the condition:

$$Rv/Ye > 7$$

where Ye is ½ of the length of short side of the panel.

10. The color cathode ray tube according to claim 9, wherein the panel is shaped so as to satisfy the condition:

$$Rv \times CFT^{-2.79} < 2.0$$

where CFT (Center Face plate Thickness) is a thickness of a center portion of the panel.

11. The color cathode ray tube according to claim 9, wherein the panel is shaped so as to satisfy the following conditions:

$$Rv/Ye > 7, \text{ and}$$

$$Rv \times CFT^{-2.79} < 2.0$$

where Ye is ½ of the length of a short side of the panel, and CFT (Center Face plate Thickness) is the thickness of a center portion of the panel.

12. The color cathode ray tube according to claim 9, wherein Rh and Rt are finite values.

* * * * *